United States Patent [19]

Denzer

[11] 4,016,999

[45] Apr. 12, 1977

[54] AIR EVACUATING CLOSURE

[75] Inventor: Alan R. Denzer, Greenwich, Conn.

[73] Assignee: Zamax Manufacturing Co., Inc., Belleville, N.J.

[22] Filed: June 15, 1976

[21] Appl. No.: 696,202

[52] U.S. Cl. ..... 220/231; 53/88

[51] Int. Cl.[2] ..... B65D 51/16

[58] Field of Search ..... 53/88; 206/315 B; 220/204, 206, 209, 231, 367, 368

[56] References Cited

UNITED STATES PATENTS

| | | | |
|---|---|---|---|
| 1,491,562 | 4/1924 | Stearns | 53/88 |
| 2,648,474 | 8/1953 | Crook | 53/88 X |
| 2,890,810 | 6/1959 | Rohling | 220/231 |
| 3,672,114 | 6/1972 | Sacks | 53/88 |

*Primary Examiner*—Travis S. McGehee
*Attorney, Agent, or Firm*—Irving Seidman

[57] ABSTRACT

An air evacuating closure adapted for use with a container whereby the contents of a container can be maintained stored under a negative pressure environment after the container has been opened. The evacuating closure includes a member which forms a closure top for a container, and which closure top incorporates a pump for evacuating any air from a container. The closure also includes a vent for venting the container when under a negative pressure to facilitate the removal of the closure.

1 Claim, 3 Drawing Figures

AIR EVACUATING CLOSURE

PROBLEM AND PRIOR ART

Many products, such as coffee, are packaged in containers under a negative pressure in order to maintain the freshness of the product. However, once the container has been opened the product or content thereof was no longer kept under the desired negative pressure environment. Heretofore various efforts have been made to provide a staisfactory air evacuating closure; as evidenced by U.S. Pat. Nos.: 3,672,114; 2,890,810; 2,506,362 and 1,005,349. However, the prior known constructin appear to be complex and difficult and/or costly to make. As a result, it is not known that any of the known structures have achieved any commercial importance.

OBJECTS

It is an object of this invention to provide an improved air evacuating closure which can be readily adapted to a container whereby the contents in the container can be maintained under a negative pressure subsequent to the initial opening thereof.

Another object is to provide an air evacuating closure which is relatively simple in construction and positive in operation.

Another object is to proivde an air evacuating closure which can be readily removed even when the container is under a negative pressure.

SUMMARY OF INVENTION

The foregoing objects and other features and advantages are attained by a closure constructed to seal the open end of a container. Associated with the closure is a piston pump for evacuating the air from the container. The pump is located over a unidirectional flapper valve so that the air is exhausted from the container upon the up strike of the pump piston. The pump piston in turn is provided with a unidirectional exhaust valve whereby the evacuated air is exhausted to atmosphere upon the downward stroke of the pump piston. To facilitate the removal of the closure when the same is under a negative pressure, a vent is provided for breaking the vaccum within the container.

FEATURES

A feature of this invention resides in the provision of an air evacuating closure for resealing a container and subjecting the interior of the container to a negative pressure environment.

Another feature resides in an improved air evacuating closure having a vent for facilitating the removal of the closure from the container when under a negative pressure.

Another feature resides in the provision of an air evacuating closure which is relatively simple in construction, inexpensive to manufacture and positive in operation.

Other features and advantages will become more readily apparent when considered in view of the drawings and specification in which.

DETAILED DESCRIPTION

Figure 1:
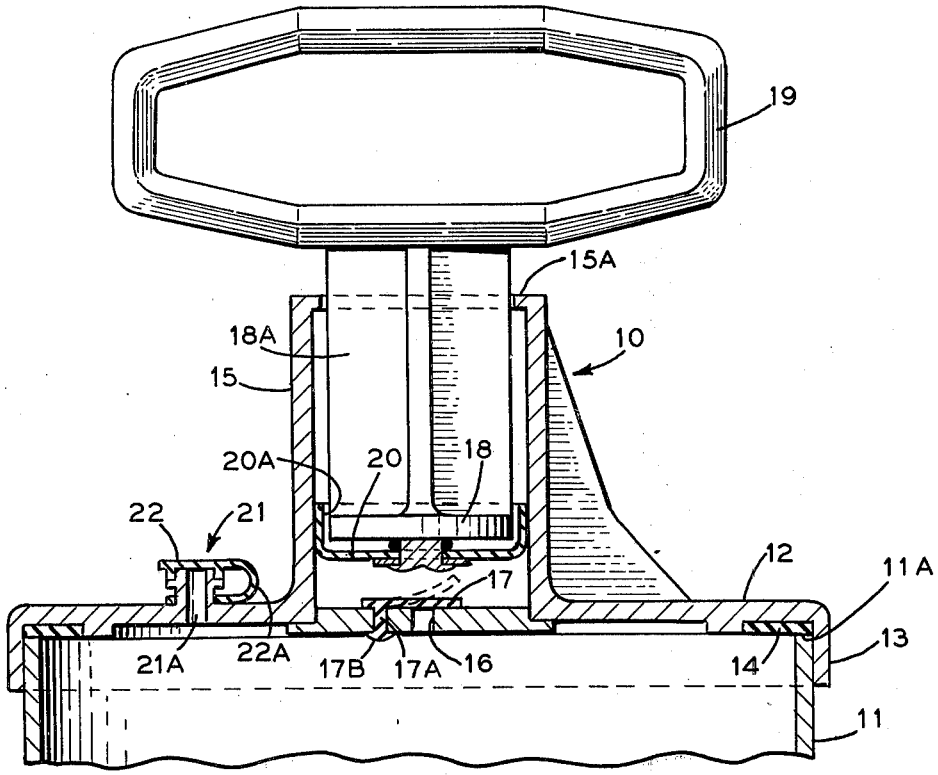
FIG. 1 is a vertical sectional view of an air evacuating closure of the present invention.

Referring to the drawings, there is shown in FIG. 1 an air evacuating closure 10 embodying the present invention, which is illustrated as applied to a container 11, e.g., a coffee can and the like. The air evacuating closure 10 of this invention is particularly adapted for resealing a container 11 in which various products are sold, which requires for their maintained freshness that they be resealed and maintained under a negative pressure.

As shown, the closure 10 of FIg. 1 comprises a top wall portion 12 which is circumscribed by a depending flange 13, arranged to fit the upper end of a container 11. Disposed about the circumference of the top portion 12 is a sealing washer 14 which in the operative position sets upon the upper edge 11A of the container 11.

Projecting above the top portion 12 of the closure 10 is a tubular extension or cylinder 15. The upper end of the cylinder 15 is provided with an inturned circumscribing shoulder 15A.

Formed on the top portion 12 within the tubular extension or cylinder 15 is an opening 16 which is in communication with the interior of the container 11. A flapper type valve 17 is disposed over the opening 16 to normally maintain the opening 16 closed. It will be understood that the flapper valve 17 may be formed of a suitable flexible material such /as rubber, plastic or the like which can be readily flexed to an open or raised position as indicated in the dottled line shown as will be hereinafter described. The flapper valve 17 is held or fixed at one end to the top 12 by an integrally formed anchor or pin 17A which extends through the top portion 12; and which is held in place by a enlarged head end portion 17B.

Slideably disposed within the cylinder or tubular extension 15 is a piston 18. Connected to the piston is a piston rod 18A which is shown as being cuniform in cross section. To the upper end of the piston rod 18A there is connected a handle 19 whereby the piston is actuated.

Connected to the piston 18 is a sealing means which defines with the walls of the cylinder a unidirectional exhaust valve. The sealing means or exhaust valve means includes a sealing cup 20 having flexible circumscribing flange 20A which is formed to define a seal with the internal wall of the cylinder 15 on the up stroke of the piston 18; and which on the down stroke of the piston will cause the air trapped between the top of the closure and the piston to exhaust about the ends of the seal flange 20A. Thus, the seal flange 20A is somewhat flexible with sufficient space provided between the piston 18 and the internal wall of cylinder 15 to exhaust the air as will be hereinafter described. From the foregoing description, it will be apparent that the pump means described constitutes an integral part of the closure or top 10.

Thus to reseal the contents of a container 11, which is required to be maintained under a negative pressure, once the container 11 has been opened, the described closure 10 is placed over the open end of the container 11. The air within the container 11 is evacuated from the container by actuating the pumping means several times. The arrangement is such that when the piston is displaced to its upper most position, the suction created thereby causes the flapper valve 17 to open as indicated by the dotted lne showing, causing the air within the container to be drawn into the cylinder extension 15. Upon the downward movement of the piston 18, the flapper valve is moved to its closed position whereby the evaucated air trapped between the top of the closure 12 and the piston 18 within the cylinder 15 is caused to be exhausted to atmosphere by escaping around the seal flange 20A. Upon each stroke of the piston 18, the cycle of withdrawing air from the container 11 and exhausting the evacuated air is repeated. Accordingly, the piston 18 is actuated until the desired negative pressure is attained.

To effect the release of the closure 10 when the container 11 is under a negative pressure, a venting means 21 is provided. As shown in FIG. 1, the venting means 21 comprises a vent opening 21A which communicates the interior of container 11 to atmosphere, and which vent opening 21A is closed by a vent cap or closure 22. In the illustrated embodiment, the vent opening is defined in a boss which is integral with the top wall 12 of the closure. The vent cap or closure 22 is formed with a connected flexible hinge portion 22A which is secured to the boss defining the vent opening. The vent cap or closure is formed of a suitable plastic whereby it can be frictionally secured to the vent 21 to seal it from atmosphere. Thus to relieve the negative pressure within the container to effect removal of the closure 10 from the container, one need only to open the vent 21 by uncovering the vent closure 22 from the vent opening 21A.

Figure 2:
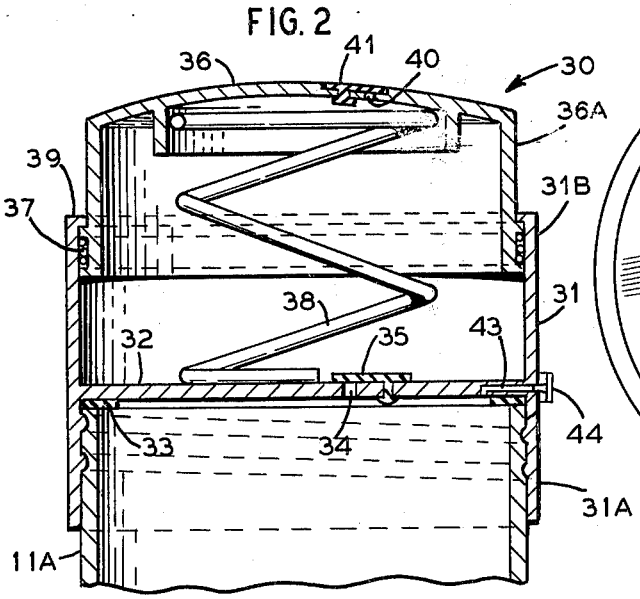
FIG. 2 is a sectional view of a modified embodiment.
Figure 3:
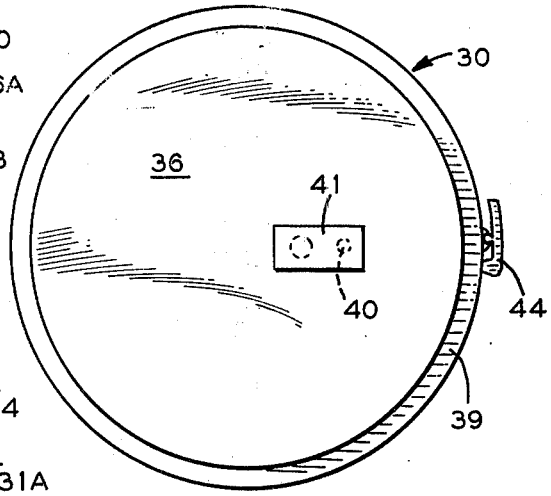
FIG. 3 is a top plan view of FIG. 2.

FIGS. 2 and 3 illustrate a modified embodiment. In this embodiment, the closure 30 comprises a circumscribing cylindrical side wall portion 31 which has a partition 32 extending transversely intermediate the ends of the side wall portion 31. The partition 32 thus defines the top closure for the container, with the lower portion 31A of the side wall 31 circumscribing the upper end of the container 11A. In the illustrated form of the invention, the lower portion 31A of the side wall may be provided with suitable threads or bayonette type connection whereby the closure 30 may be threaded to the upper end of a threaded container 11A. The under surface of the partition 32 is provided with a sealing washer 33 to define a seal with the upper end of the container.

The upper portion 31B extends upwardly from the partition 32 to define the cylinder portion of a pump means. As shown, the partition has formed therein an opening 34 which is closed by a flapper type valve 35 similar to that described with respect to FIG. 1.

Reciprocally mounted relative to the upper portion 31B of the closure 30 is a plunger piston 36. The side walls 36A of the piston are slideable disposed within the upper portion 31B of the closure 30. One or more sealing rings, e.g., O-rings 37 are disposed about the plunger piston' said wall 36A to define a fluid tight seal.

Disposed between partition 32 and the top of the piston 36 is a spring 38 for normally biasing the piston to its upper most position as noted in FIG. 2. The upper end of the closure is provided with an inturned shoulder 39 to function as a stop for the piston 36.

Formed in the upper end of the piston 36 is a hole or exhaust opening 40 which is closed by a flapper vlave 41. In operation, it will be noted that upon the upper stroke of the plunger piston 36, air is evacuated from the container 11 in a manner as hereinbefore described with respect to FIG. 1. Upon the downward stroke of the piston 36, the air trapped between the partition 32 and the piston 36 is exhausted through the valved exhaust port or opening 40.

It will be noted that the desired vacuum or negative pressure can be placed upon the contents of container 11A by actuating the piston 36 through several cycles. It will also be noted that the flapper valves 35 and 41 of FIG. 2 are similar in construction to that hereinbefore described.

To vent the container 11A to atmosphere to facilitate the removal of the closure when the container is under a negative pressure, a venting means is provided. In this form of the invention, the vent means comprises a passageway 43 formed in partition 32 which communicates the interior of the container 11A to atmosphere. As best seen in FIGS. 2 and 3, a closure in the form of a lever 44 is pivotally mounted to the side of the closure for valving the passageway between open and closed positions. It will be understood that the valve 44 is normally sealing the passageway 43 closed, and that the interior of the container is vented when the lever 44 is depressed.

From the foregoing description, it will be apparent that variations and modifications may be made without departing from the spirit and scope of the invention.

What is claimed is:

1. A device for evacuating a container comprising:

a closure adapted to seal the open end of a container, said closure having a circumscribing sealing edge adapted to rest on the edge of a container, a tubular extension projecting above said closure, said closure having an opening located within the area defined by said tubular extension, said opening being in direct communication with the interior of the container, a flapper valve for normally sealing said opening closed a piston slideably disposed within said tubular extension, a piston rod connected to said piston, said piston comprising a sealing cup having a connected circumscribing flexible sealing flange, said sealing flange defining with the walls of said tubular extension a unidirectional exhaust valve, a handle connected to said piston rod for actuating said piston, and a vent means in said closure for venting the interior of the container to facilitate the removal of said closure when the interior of the container is under a negative pressure, said vent means including a vent opening defined by a projecting boss formed on said closure, said vent opening communicating directly with the interior of said container, and a vent closure for sealing said vent opening, said vent closure being frictionally secured to said boss for sealing said vent opening, and a flexible hinge connecting said vent closure to said boss.

* * * * *